US007948831B2

(12) United States Patent
Orcutt et al.

(10) Patent No.: US 7,948,831 B2
(45) Date of Patent: May 24, 2011

(54) SMART SHOWER, A MOTION ACTIVATED SHOWER TIMER AND ALARM WITH DIVERSION RELATED SOUNDBYTES FOR ENTERTAINING OR INFORMING USED TO CONSERVE ENERGY AND WATER

(76) Inventors: Peter Allen Orcutt, Orleans, MA (US); Patricia Ann Orcutt, Orleans, MA (US); Justin Matthew Pascarelli, Chatham, MA (US); Melissa Ann Pascarelli, Chatham, MA (US)

( * ) Notice: Subject to any disclaimer, the term of this patent is extended or adjusted under 35 U.S.C. 154(b) by 0 days.

(21) Appl. No.: 12/655,738

(22) Filed: Jan. 6, 2010

(65) Prior Publication Data

US 2010/0172218 A1 Jul. 8, 2010

Related U.S. Application Data

(60) Provisional application No. 61/204,529, filed on Jan. 8, 2009.

(51) Int. Cl.
*G04B 47/06* (2006.01)
*G04F 10/00* (2006.01)

(52) U.S. Cl. ..... 368/11; 368/109

(58) Field of Classification Search ..... 368/11–12, 368/107–123

See application file for complete search history.

(56) References Cited

U.S. PATENT DOCUMENTS

| | | | | |
|---|---|---|---|---|
| 4,262,842 | A * | 4/1981 | Grover et al. | 377/15 |
| 4,443,114 | A * | 4/1984 | Kumata | 368/73 |
| 5,652,568 | A * | 7/1997 | Ko | 340/567 |
| 5,829,072 | A * | 11/1998 | Hirsch et al. | 4/605 |
| 6,850,167 | B2 * | 2/2005 | Rosen | 340/689 |
| 6,899,133 | B2 * | 5/2005 | Brunkhardt | 137/624.11 |
| 7,027,358 | B1 * | 4/2006 | Esposito et al. | 368/10 |
| 7,264,377 | B2 * | 9/2007 | Cooper et al. | 362/276 |
| 7,283,427 | B1 * | 10/2007 | Stevens | 368/12 |
| 7,400,259 | B2 * | 7/2008 | O'Connor et al. | 340/573.1 |
| 7,522,031 | B2 * | 4/2009 | Lim | 340/309.16 |
| 7,651,365 | B2 * | 1/2010 | Chien | 439/490 |
| 2002/0181336 | A1 * | 12/2002 | Shields | 368/109 |
| 2003/0125842 | A1 * | 7/2003 | Chang et al. | 700/282 |
| 2003/0206496 | A1 * | 11/2003 | Neilly | 368/108 |
| 2003/0214884 | A1 * | 11/2003 | Wilmore | 368/108 |
| 2005/0030835 | A1 * | 2/2005 | Dutkiewicz | 368/111 |
| 2005/0174889 | A1 * | 8/2005 | Marcantonio et al. | 368/12 |
| 2008/0130417 | A1 * | 6/2008 | Bhavnani | 368/11 |
| 2009/0126810 | A1 * | 5/2009 | Currie | 137/624.12 |
| 2009/0185450 | A1 * | 7/2009 | Nanda | 368/10 |
| 2009/0293190 | A1 * | 12/2009 | Ringelstetter et al. | 4/605 |
| 2009/0320227 | A1 * | 12/2009 | Cohen et al. | 15/167.1 |

* cited by examiner

*Primary Examiner* — Renee S Luebke

(57) ABSTRACT

A sound device with a motion detector. The device is used to provide a diversion while user occupies the shower, at the same time keeping track of time and alarming the occupant when time has elapsed. For example: A minute after entering the shower, the timer automatically starts and a trivia question is posed to the occupant. The occupant then has a predefined amount of time to come up with the answer. Upon time lapse, the answer is provided with a gentle reminder that your time is over. Any other variations on this principle are possible.

4 Claims, 1 Drawing Sheet

SMART SHOWER, A MOTION ACTIVATED SHOWER TIMER AND ALARM WITH DIVERSION RELATED SOUNDBYTES FOR ENTERTAINING OR INFORMING USED TO CONSERVE ENERGY AND WATER

We would like to claim priority of provisional application No. 61/204,529 filed on Jan. 8, 2009.

CROSS REFERENCE TO RELATED APPLICATIONS

Not applicable

STATEMENT OF FEDERALLY SPONSORED RESEARCH/DEVELOPMENT

Not applicable

REFERENCE TO A "SEQUENCED LISTING"

Not applicable

BACKGROUND OF THE INVENTION

Long showers by teenagers are a constant source of frustration and financial drain on parents. Getting teenagers to use a traditional shower timer or water limiter has proven difficult. As parents, the inventors have attempted to come up with a solution to this very problem.

This invention relates to a motion detector incorporating a timed sound-byte device. Motion detectors have been widely used for entertaining people in conjunction with toys and other devices. After a motion is detected, a toy will make a motion or give a sound byte. Motion detectors can alarm a person to an intruder, as used in an outside spotlight on a house. Motion detectors are also used to make things easier by automatically performing a function such as opening doors at the supermarket.

No one has come up with a shower device that is hands and eyes-off, which will in a diversional, entertaining, or informing way remind the shower user to conserve water, save energy used to heat the water and to reduce sewer and septic loading.

Until now, a shower user could set an alarm or watch a clock. Both of these can be challenging and undesirable for young people and generally are not used with consistency in other generations. The other option is a draconian device that is costly and limits the amount of water after a set time.

In summary, to enhance all aspects and to improve water saving devices, Smart Shower uses the novel features of automatically starting the timer and diverting the occupant in an informative and entertaining way while showering.

BRIEF SUMMARY OF THE INVENTION

Without any other fun, entertaining and appealing solution to save water, by limiting shower use, Smart Shower provides a solution to all these problems. Saving water and the energy required to heat has obvious environmental and financial benefits. Tolls on septic and sewer systems will be reduced, also saving money.

Smart Shower provides an automatic water-saving device. When a person enters the shower, a motion detector starts a timer, after a predetermined time a sound byte is played and at a second predetermined time another related sound-byte is played to inform the occupant to exit the shower.

Upon entering the shower, motion is detected. At a preset time, a sound byte is played as a diversion. This sound byte could consist of music, a question, ring tone, trivia, comedy, celebrity parody, brainteaser, information or any other sound byte. At a second predetermined time, a related sound-byte is played to let the person know an elapsed time has occurred to exit the shower.

DETAILED DESCRIPTION OF THE INVENTION

Figure 1:
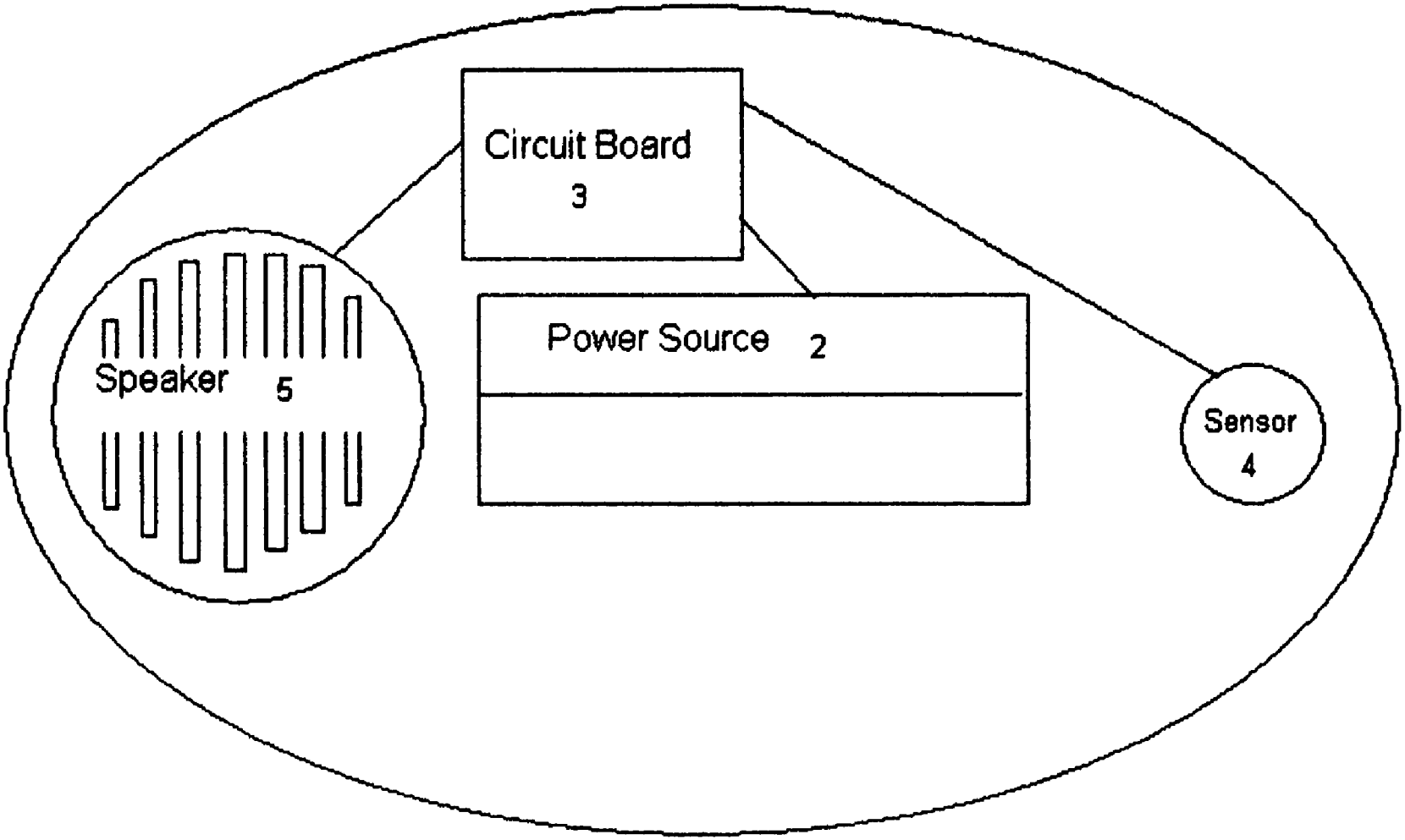
FIG. 1 is a diagram of the Smart Shower with a motion detector connected to a power source. A power source is connected to a circuit board. A circuit board is connected to the speaker.

The embodiment of FIG. 1 shows a housing with a motion sensor. This could be any type of sensor to detect an occupant, connected to a controller, which will likely be a pressed circuit board.

When the occupant reaches in the shower to turn on the water, the sensor sends a signal to the controller, which will play the sound byte after a period of time sufficient to initially heat the water.

After another predetermined time, the occupant will be prompted to exit the shower with a related sound-byte.

The controller is connected to the power source, likely to be batteries in a watertight compartment.

Sound bytes are stored in memory chips, which are accessed as needed by the controller at the beginning and end of the shower.

The sound bytes are in sets of two and are related in some way. Every set will be related in an overall theme.

For example: question byte "What do squirrels like?"; answer byte "Nuts" and question byte "What do bears like?"; answer byte "Honey". These are two sets of related bytes that are also related in an overall theme.

When a sound byte is played, the signal is sent to the amplifier, which amplifies the signal. A speaker is connected to the amplifier, that converts the audio signal into sound.

Sound bytes will consist of information that may be used in houses, hotels, resorts, public showers and motor lodges. Bytes may consist of entertaining comedy, political parody, celebrity parody, movie quotes, TV quotes, music ring-tones, questions and answers, trivia, riddles, mind benders, brainteasers and quotes from books.

This purpose of the device is to conserve water, energy, septic and sewer loading, and to conserve the immediate availability of hot water.

The invention claimed is:

1. A shower timer capable of operation without the use of hands or eyes, the shower timer is housed inside a watertight housing and consists of:

a speaker;

a power source;

a circuit capable of performing timing operations;

a motion sensor capable of detecting motion external to and independent of the shower timer;

wherein the shower timer is operable to detect motion and subsequently start a timing operation, wherein after a first predetermined time a first audio content is output using the speaker, after a second predetermined time subsequent to the first predetermined time a second audio content is output using the speaker, and stop the timing operation;

the first predetermined time is a time period sufficient to initially heat water after first activating a shower; and the second predetermined time is a time period sufficient for a user to take a shower.

2. The shower timer of claim 1, wherein said first audio content and said second audio context share a common theme.

3. The shower timer of claim 2, wherein said first audio content comprises a question and said second audio content comprises an answer to said question.

4. The shower timer of claim 2, wherein said first audio content is one or more of:

(a) a sound clip excerpted from a movie;
(b) a sound clip excerpted from a television program;
(c) an audible summary of current weather conditions;
(d) an audible summary of one or more current news items;
(e) a sound clip of a trivia question;
(f) an audible summary of recent sports results;
(g) a sound clip of a reading of an excerpt of a book; and
(h) humorous content to encourage shorter showers.

* * * * *